US005782443A

United States Patent [19]

La Fontaine

[11] Patent Number: 5,782,443

[45] Date of Patent: Jul. 21, 1998

[54] STAND FOR SUPPORTING A GOLF CLUB IN A HIGHLY VISIBLE POSITION WHEN NOT IN USE

[76] Inventor: Judd La Fontaine, 2010 Jimmy Durante Blvd. #220, Del Mar, Calif. 92104

[21] Appl. No.: 911,995

[22] Filed: Aug. 15, 1997

[51] Int. Cl.[6] ..... A63B 55/10

[52] U.S. Cl. ..... 248/156; 473/282

[58] Field of Search ..... 473/282; 248/156, 248/530; 211/70.2; 206/315.2

[56] References Cited

U.S. PATENT DOCUMENTS 5,285,990 2/1994 Engel ..... 248/156

5,417,334 5/1995 Wu ..... 211/70.2

5,437,449 8/1995 Zink ..... 473/286

5,636,754 6/1997 Ennis ..... 211/70.2

*Primary Examiner*—Sebastiano Passaniti

*Assistant Examiner*—Stephen L. Blau

*Attorney, Agent, or Firm*—Gene W. Arant

[57] ABSTRACT

A stand which supports a golf club in a highly visible and easily retrievable position above a grassy surface. The stand has a top plate with two spaced spikes extending downward from an under side of the top plate and adapted to be driven into the grassy surface. A column extends vertically upwardly from an upper surface of the top plate and internally engages and supports the club. A cylindrical securing means is attached to the top plate which encircles the club and cooperates with the column for maintaining the club in a vertical disposed position.

3 Claims, 3 Drawing Sheets

STAND FOR SUPPORTING A GOLF CLUB IN A HIGHLY VISIBLE POSITION WHEN NOT IN USE

BACKGROUND OF THE INVENTION

Golfers must carry several different clubs with them while playing a game. From time to time a particular club that has just been used is laid aside while a different club is then selected for further use. Experience has shown that golfers sometime forget the club that was momentarily laid aside, and it becomes lost or stolen.

SUMMARY OF THE INVENTION

The present invention starts with the concept that if a club that is not being used can conveniently and easily be placed in a highly visible position from which it may be easily retrieved, then the incidence of such loss or theft will be greatly reduced.

According to the present invention I provide a stand for supporting a golf club in a highly visible and easily retrievable position above a grassy surface, which includes a base member with a generally horizontal top plate having at least two horizontally spaced spikes depending downwardly from the top plate to be driven into the grassy surface. The remaining portion of the under side of the top plate then directly engages the grassy surface.

The unused club is then placed in vertically disposed position with its lower end resting above the top surface of the top plate. My stand further includes a column or pedestal that extends vertically upward from the top plate so that it is in parallel with a substantial portion of the length of the club. The column engagingly supports the club at a finite distance above its lower end. My novel stand also includes an encircling mechanism at a finite distance above the lower end of the column which at least partially encircles the club and cooperates with the column for removably engaging the club and maintaining the club in its vertically disposed position. The encircling device is supported in a fixed relation to the column for reliably maintaining the club in its vertically disposed position.

DRAWING SUMMARY

DETAILED DESCRIPTION OF FIRST PREFERRED EMBODIMENT (FIGS. 1–4)

Figure 1:
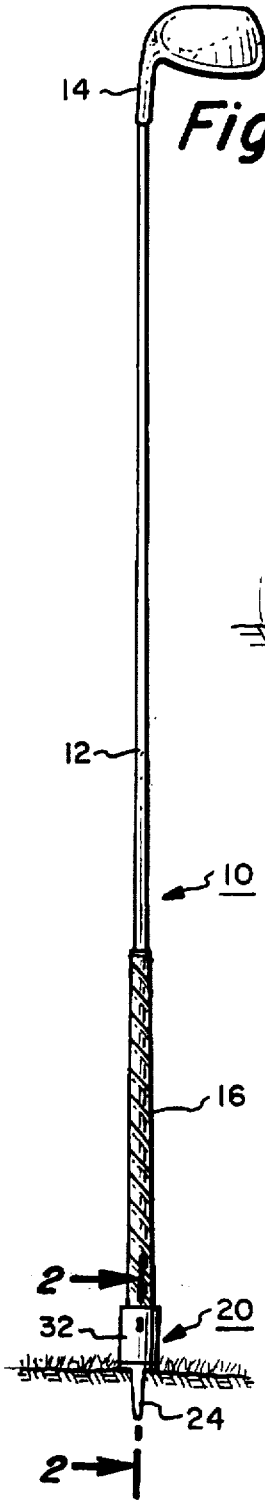
FIG. 1 is an elevation view of a golf club supported at its butt end from a first preferred embodiment of my invention.
Figure 2:
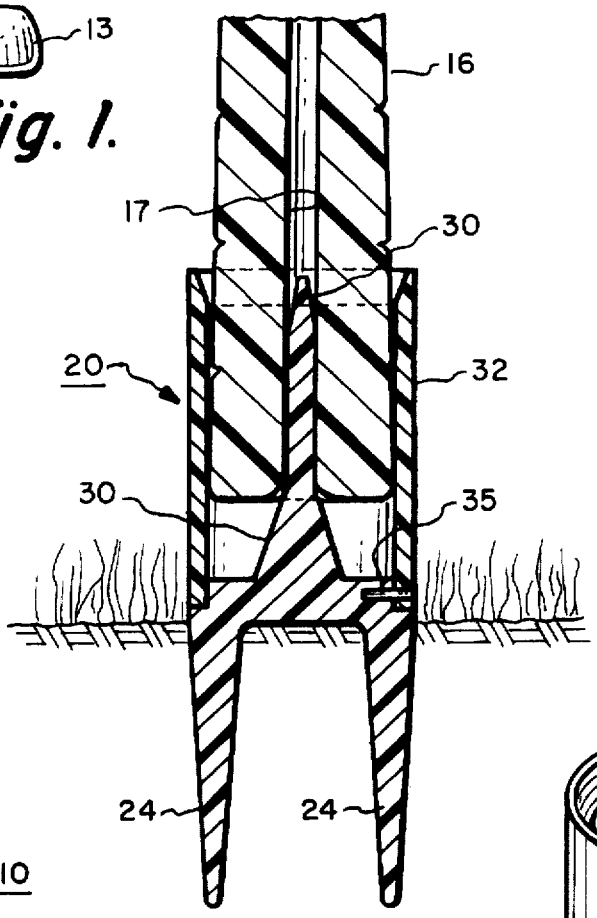
FIG. 2 is an enlarged vertical cross-sectional view of the stand of FIG. 1 together with the butt end of the club.

The club 10 as seen in FIGS. 1 and 2 has an elongated shaft 12, a driving head 13, a metal shank 14 connecting the driving head to the shaft, and a butt end 16. An elongated recess or hole 17 is centrally formed in the butt end. The conventional purpose of the hole or recess 17 is to store a golf tee.

Figure 4:
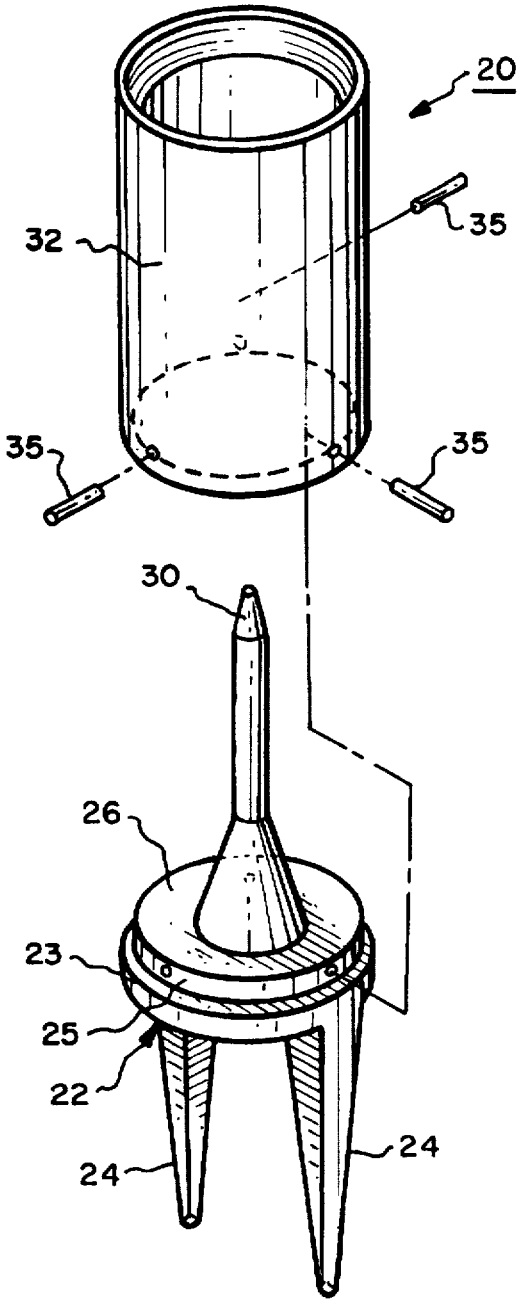
FIG. 4 is a perspective view of the stand of FIG. 1 when disassembled into its component parts.
Figure 5:
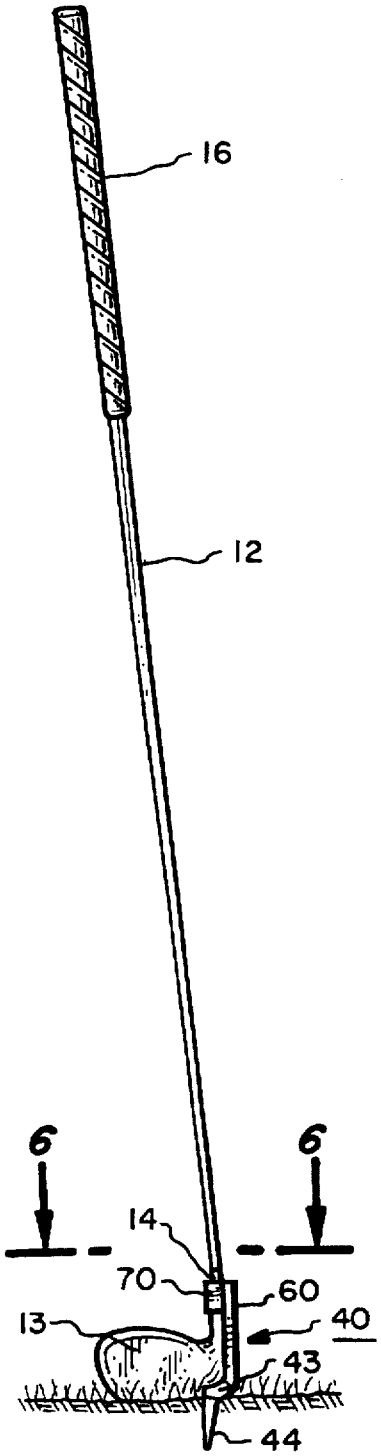
FIG. 5 is an elevation view of a golf club supported at its head end from a second preferred embodiment of my invention.
Figure 6:
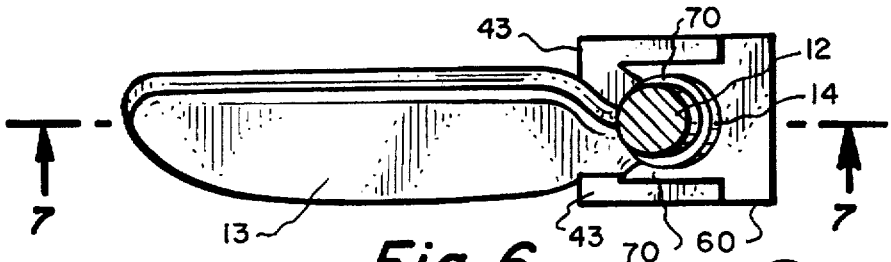
FIG. 6 is an enlarged horizontal cross-sectional view taken on the line 6—6 of FIG. 5.
Figure 8:
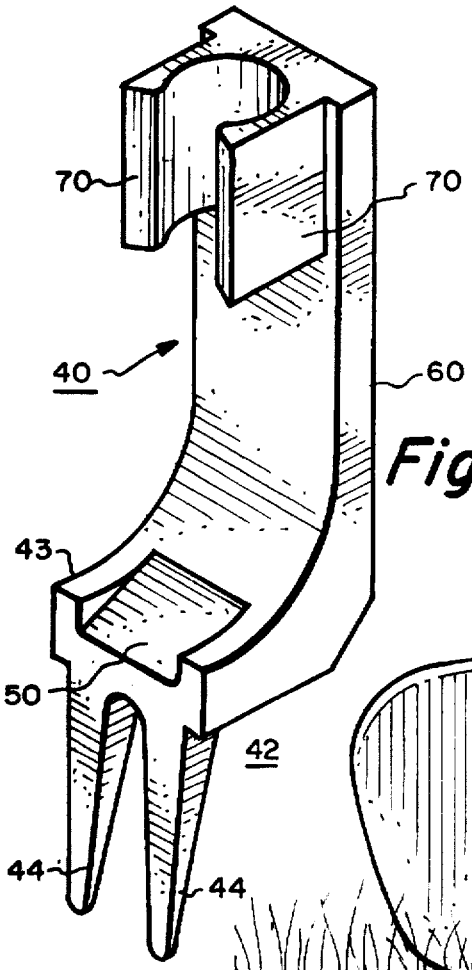
FIG. 8 is a perspective view of the stand of FIGS. 5–7.

The stand 20 includes a base member 22, best understood from FIG. 4, which has a generally horizontal top plate 23. Two horizontally spaced spikes 24 depend downwardly from the under side of the top plate 23. The top plate 23 is of circular shape and has on its upper surface a raised circular portion 26 that provides a radially recessed circumferential wall 25. From the center of the upper surface of raised portion 26 a column 30 extends vertically upward. The column 30 is in the form of a typical golf tee, with its enlarged or head end secured to the surface of raised portion 26.

Figure 3:
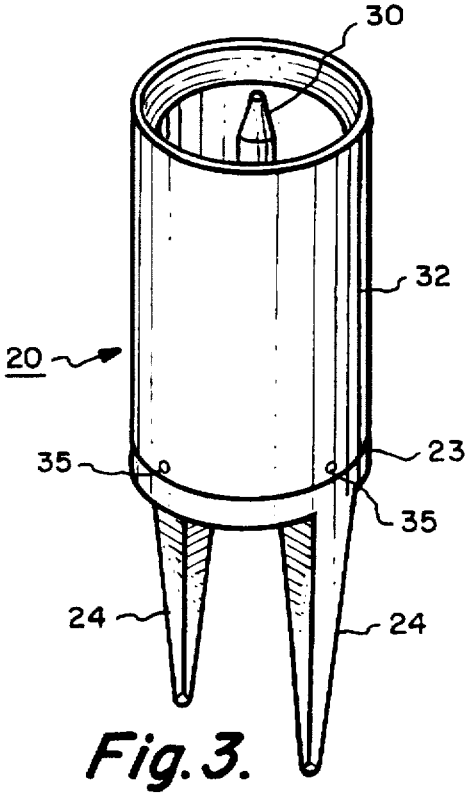
FIG. 3 is a perspective view of the stand of FIG. 1 in its assembled form

Also included in the stand 20 is a hollow cylindrical housing 32. In the assembled form of the stand as shown in FIG. 3, the lower end of housing 32 is fitted about circumferential wall 25 and is secured there by means of three pins 35 that are driven radially inwardly.

Both the base member 22 and the cylindrical housing 32 are preferably injection molded from a relatively rigid plastic material. The spikes 24 are narrowed at their lower ends and hence adapted to be driven into the grassy surface by pressure applied to the top plate 23. The remaining portion of the under side of the top plate 23 then directly engages the grassy surface, as best shown in FIG. 2.

The butt end 16 of club 10 is inserted into the upper end of housing 32, and the column 30 then becomes inserted internally into the hole or recess 17, as shown in FIG. 2. It is important that the wall of cylindrical housing 32 is adapted to at least partially encircle the club at a finite distance above its lower end, and then cooperates with the central column 30 for securing the club in its vertically disposed position. Pins 35 securely attach the cylindrical securing wall 32 to the peripheral wall 25 of the top plate 23 of base member 22 for holding the securing wall 32 in fixed relation to the central column 30.

DETAILED DESCRIPTION OF SECOND PREFERRED EMBODIMENT (FIGS. 5–8)

Reference is now made to FIGS. 5–8 illustrating the second preferred embodiment of my invention, in which the golf club 10 is supported at its head end.

The stand 40 for supporting the golf club 10 from its head end is preferably integrally formed as a single piece of plastic material.

Figure 7:
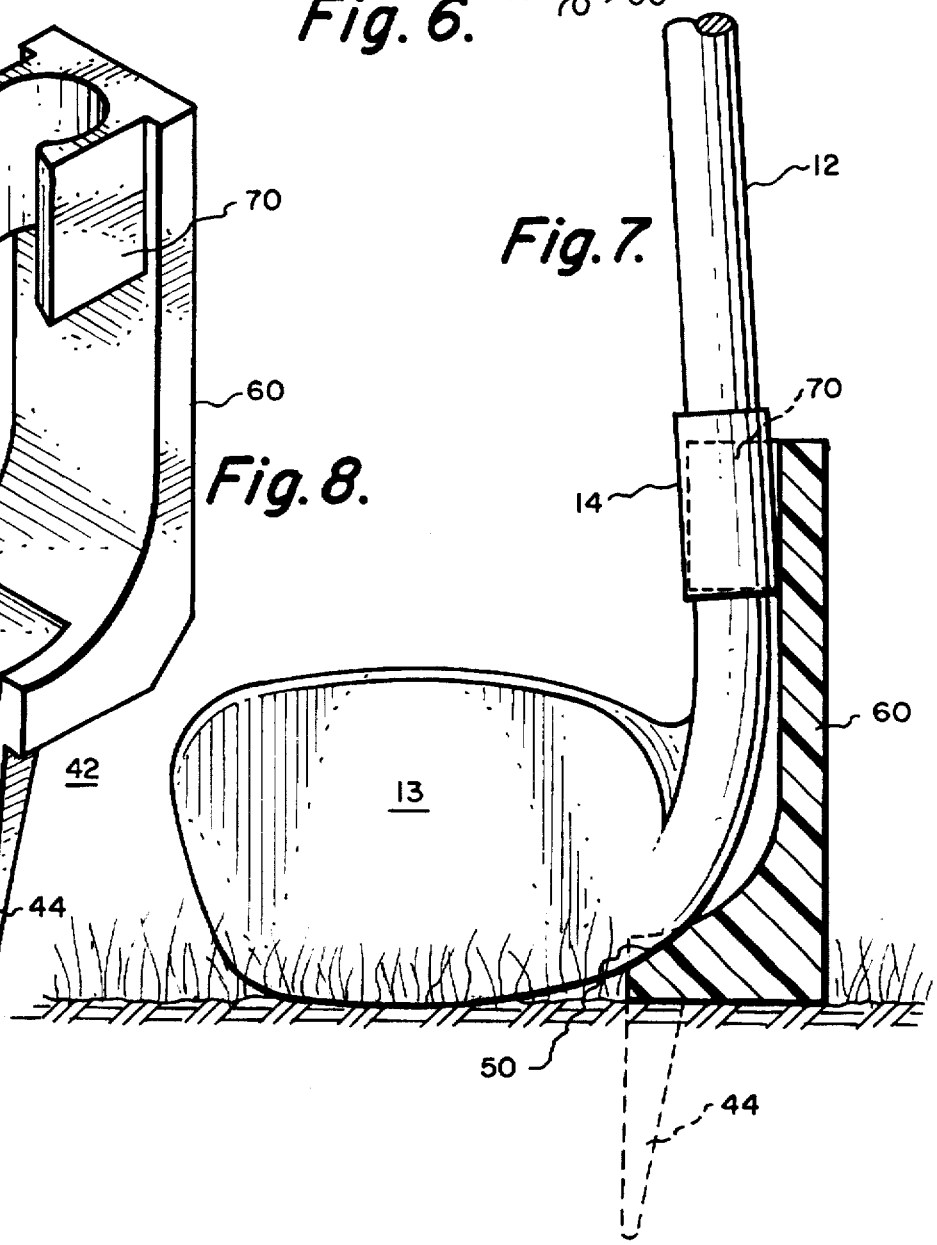
FIG. 7 is an enlarged elevation view of the head end of the golf club of FIG. 5, showing my novel stand in cross-section.

A base member 42 includes a generally horizontal top plate 43, and two horizontally spaced spikes 44 depending downwardly from the under side of the top plate and adapted to be driven into the grassy surface. The club 10 is placed in vertically disposed position with its head 13 resting in a notch 50 upon the top surface of the top plate 43, while the remaining portion of the under side of top plate 43 directly engages the grassy surface. A column 60 extends vertically upwardly from the upper surface of the top plate of the base member 40 near a lateral edge thereof, opposite to the notch 50, and extends in parallel with a substantial portion of the length of the club. The shank 14 of the club engages and is supported by the column 60, as seen in FIG. 7. A finite distance above the lower end of the column 60 a pair of parallel flanges 70 are formed that extend horizontally outward from the column and over the central portion of the base member. The flanges 70 are adapted to at least partially encircle the club for removably engaging the club and for maintaining the club in its vertically disposed position. Since all of the parts are integrally formed as one, the securing flanges 70 are therefore fastened securely to the column 60 for holding it in fixed relation thereto, and thus firmly supporting the club 10.

While many modifications will be apparent to those skilled in the art, the invention has been fully disclosed in its presently preferred form to satisfy the requirements of the patent laws, and it will be understood that the scope of the invention is to be judged only in accordance with the appended claims.

I claim:

1. A stand for supporting a golf club in a highly visible and easily retrievable position above a grassy surface so as to protect it from possible loss while not being used, comprising:

a base member including a generally horizontal top plate, and at least two horizontally spaced spikes depending downwardly from the under side of the top plate and adapted to be driven into the grassy surface by pressure applied to the top plate, so that the golf club may be placed in vertically disposed position with its lower end resting above the top surface of the top plate while the remaining portion of the under side of the top plate directly engages the grassy surface;

a column extending vertically upward from the upper surface of the top plate, capable of being in parallel with a substantial portion of the length of the club and internally engagingly and supporting the club;

securing means capable of at least partially encircling the club at a finite distance above the top plate of the base member and cooperating with the column for removably maintaining the club in its vertically disposed position; and fastening means capable of holding the securing means in fixed relation to the column.

2. A golf club stand as in claim 1 which is adapted to support a club from its butt end, wherein the column is a central pin extending upward from the upper surface of the base member top plate, and the securing means is formed as a cylindrical wall that is attached to the outer periphery of the top plate of the base member.

3. A stand for protecting from possible loss while it is not being used, a golf club that has a butt end with a central recess formed therein, by supporting the club above a grassy surface in a highly visible and easily retrievable position, the stand comprising:

a base member including a generally horizontal top plate, and at least two horizontally spaced spikes depending downwardly from the under side of the top plate and adapted to be driven into the grassy surface by pressure applied to the top plate, so that the golf club may be placed in vertically disposed position with its butt end resting above the top surface of the top plate while the remaining portion of the under side of the top plate directly engages the grassy surface;

a column in the form of a central pin extending upward from the upper surface of the base member top plate and adapted to enter the central recess in the butt end of the club;

a cylindrical wall adapted to at least partially encircle the club at a finite distance above its lower end, and to then cooperate with the central pin for securing the club in its vertically disposed position; and fastening means attaching the cylindrical securing wall to the outer periphery of the top plate of the base member for holding the securing wall in fixed relation to the central pin.

* * * * *